United States Patent [19]

Archer et al.

[11] Patent Number: 5,027,751

[45] Date of Patent: Jul. 2, 1991

[54] METHOD AND APPARATUS FOR OPTIMIZED BOILER OPERATION

[75] Inventors: David H. Archer, Ross Twp.; M. Mustaq Ahmed, Wilkins Twp., both of Allegheny County, Pa.

[73] Assignee: Westinghouse Electric Corp., Pittsburgh, Pa.

[21] Appl. No.: 547,267

[22] Filed: Jul. 2, 1990

[51] Int. Cl.[5] ..... F22B 37/42; F22D 5/00

[52] U.S. Cl. ..... 122/449; 122/390; 122/448.1; 122/479.3; 236/14; 364/492

[58] Field of Search ..... 236/14, 15; 122/448.1, 122/4 R, 449, 479.3, 390; 60/667; 364/492, 494

[56] References Cited

U.S. PATENT DOCUMENTS

| | | | |
|---|---|---|---|
| 4,064,699 | 12/1977 | Martz | 122/448.1 X |
| 4,637,348 | 1/1987 | Fukayama | 122/448.1 X |
| 4,653,276 | 3/1987 | Sugano et al. | 122/448.1 X |
| 4,754,410 | 6/1988 | Leech et al. . | |
| 4,935,874 | 6/1990 | Volk, Jr. | 122/448.1 X |

*Primary Examiner*—Edward G. Favors
*Attorney, Agent, or Firm*—M. G. Panian

[57] ABSTRACT

Boiler operations are fine tuned to minimize thermodynamic losses and pressure losses across throttle valves at the output of a boiler. Whenever the boiler is operating outside of desired operating levels, the first action considered is to reduce spray flows into steam supplied into a reheater or superheater outputting steam at too low of a temperature. The second consideration is to reduce the use of auxiliary electrical power, such as fans supplying tempering air to the primary air used to carry fuel to the burners. The next consideration is selective soot blowing and damper adjustments to redistribute heat in combustion product exhaust gas in the boiler. Then, if possible, the quantity of flue (combustion product) as recycled is adjusted to modify the gas temperature and the heat transferred in the radiant (furnace and superheat) sections and the convective (reheat and economizer) sections of the boiler. Finally, when possible the burners are tilted or biased to move a combustion region of the fuel up or down in the furnace section of the boiler. Burner vanes are set affecting fuel-air mixing and pulverizers are adjusted modifying fuel particle size to alter both the size and position of the combustion region in the boiler. An expert system may be used to provide diagnostics and advisories to a human operator of the boiler who can then more efficiently operate the boiler.

22 Claims, 2 Drawing Sheets

METHOD AND APPARATUS FOR OPTIMIZED BOILER OPERATION

BACKGROUND OF THE INVENTION

1. Field of the Invention

The present invention is directed to efficient boiler control and, more particularly to minimizing energy loss and thermodynamic loss in a coal-fired boiler used for generating electricity.

b. 2. Description of the Related Art

Many techniques are known for controlling combustion of fuel to meet predetermined criteria. In the case of coal-fired boilers, such as those used in electricity power generating plants, boiler operation is commonly studied using computerized models. For example, EIS Systems Group of EI International, Inc. in Idaho Falls, Id. markets a product known as PEPSE which can be used for modeling boiler operation. However, there is no known system which operates on-line in real time and takes into account overall effectiveness of the boiler and supporting systems.

Typically, operators of such boilers are satisfied with producing the right amount of steam at the right pressure and temperature. The only other concern at most power plants is that emissions are within acceptable limits. Thus, for example spray flows into the reheater and platen superheater to prevent excessive temperatures in superheat and reheat steam are typically automatically controlled using a feedback mechanism which does not attempt to reduce the temperature of the superheat and reheat steam without introducing thermodynamic loss. A few boilers may be operated to minimize pressure loss across the throttle valve, but usually only by manual control of the boiler.

SUMMARY OF THE INVENTION

An object of the present invention is to operate a boiler in an efficient manner.

Another object of the present invention is to operate a boiler producing steam for an electricity generating turbine to minimize energy and thermodynamic losses occasioned in maintaining the steam at a desired temperature and pressure.

Yet another object of the present invention is to operate a boiler with minimal pressure loss across valves.

A further object of the present invention is to operate a boiler with minimal thermodynamic loss caused by the introduction of low temperature substances into the boiler to maintain the established operating temperature levels.

Yet another object of the present invention is to minimize the use of auxiliary power in a boiler.

The above objects are obtained by providing a method for controlling operation of a boiler, comprising the steps of: setting valves controlling steam output from the boiler in dependence upon a requested operation level; adjusting the air/fuel ratio for optimal operation; minimizing pressure loss across throttle valves; and minimizing thermodynamic loss caused by introduction of low temperature substances into the boiler to safely maintain the requested operation level. Thermodynamic loss is minimized by adjusting temperature distribution within the boiler to minimize the need for the introduction of low temperature substances, particularly sprays into steam to maintain the temperature of the steam, supplied to a turbine by the boiler, within a predetermined range. Also the introduction of tempering air into primary air to avoid softening or ignition of the coal in a coal-fired boiler is minimized. Temperature distribution within the boiler is controlled by adjusting dampers to decrease exhaust gas flow to sections of the furnace which produce steam or heat air that requires the addition cf water or tempering air to reduce the temperature. In addition, sections of the boiler undergo selective soot blowing to increase heat transfer upstream of a section producing steam at too high a temperature and in sections outputting a fluid at too low a temperature. The location and size of the combustion region is also adjusted to produce superheat steam at the proper temperature and pressure.

These objects, together with other objects and advantages which will be subsequently apparent, reside in the details of construction and operation as more fully hereinafter described and claimed, reference being had to the accompanying drawings forming a part hereof, wherein like reference numerals refer to like parts throughout.

DESCRIPTION OF THE PREFERRED EMBODIMENTS

Figure 1:
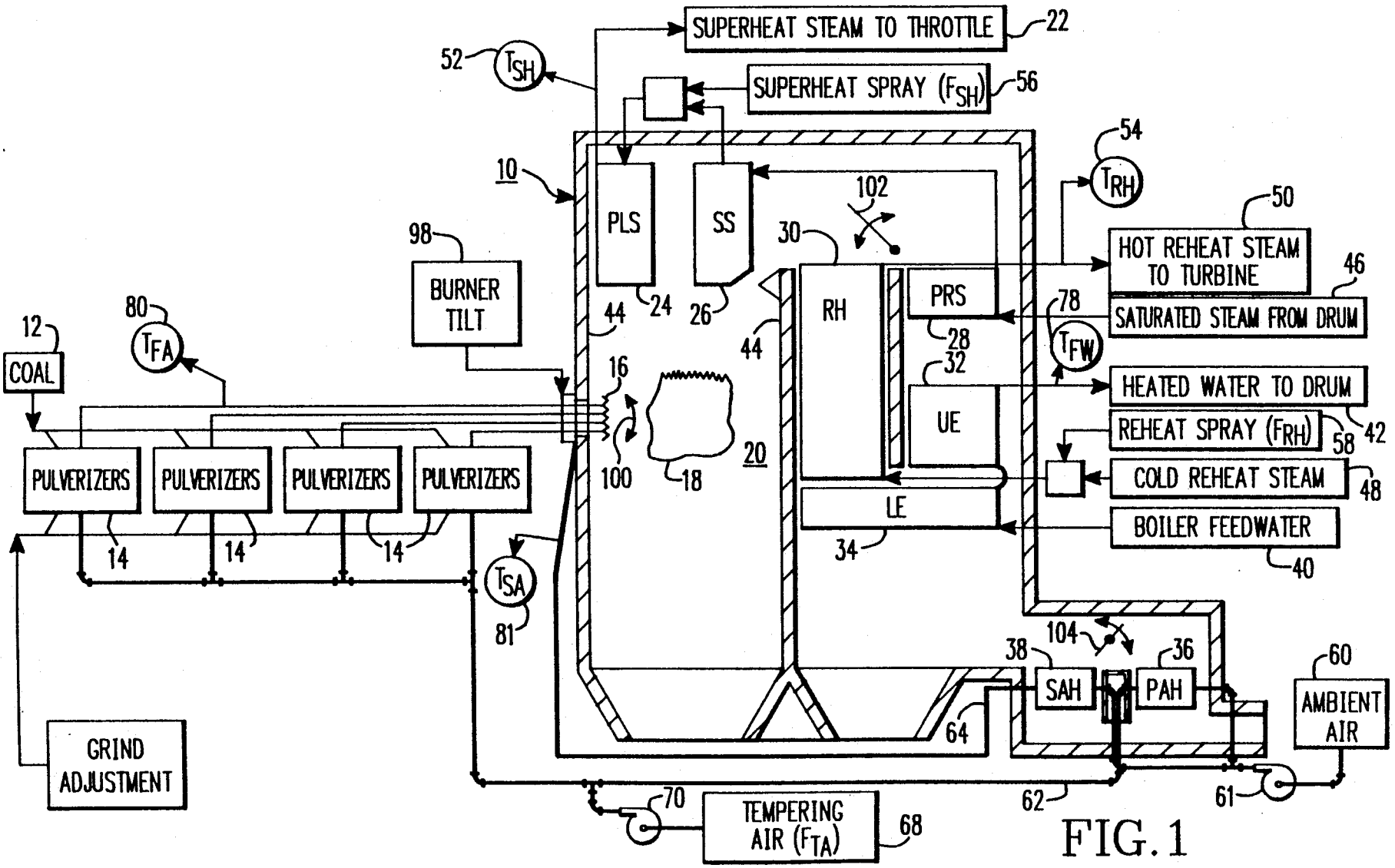
FIG. 1 is a schematic diagram of a coal-fired boiler to which the present invention can be applied.

As illustrated in FIG. 1, a typical coal-fired boiler 10 is supplied with coal 12, ground by pulverizers 14, which is burned by burners 16 that produce a combustion region 18 in a furnace 20. The exhaust gases produced by burning the coal 12 produce superheat steam 22 by passing through platen superheater (PLS) 24 and secondary superheater (SS) 26 heat exchangers. The partially cooled exhaust gases then pass through a primary superheater (PRS) 28, reheater (RH) 30, upper economizer (UE) 32 and lower economizer (LE) 34. The considerably cooled exhaust gases then pass through primary (PAH) 36 and secondary (SAH) 38 air heaters which heat the air introduced into the furnace 20.

The boiler feedwater 40 from the condenser through the feedwater heaters (not shown) is introduced into the lower economizer 34 and then passes through the upper economizer 32 prior to being supplied 42 to the walls 44 of the furnace 20. The saturated steam 46 from the furnace 20 is supplied to the primary superheater 28, then passes through the secondary superheater 26 and platen superheater 24 to produce the superheat steam 26. After being used by high pressure turbines to generate electricity, the expanded, cooled steam 48 is supplied to the reheater 30 to produce reheat steam 50.

Temperature sensors 52, 54 detect the temperature of the superheat 22 and reheat 50 steam. When the detected temperatures are above desired operating levels, sprays 56, 58 are introduced into the steam supplied to the platen superheater 24 and reheater 30 to reduce the temperature of the superheated 22 and reheated steam 50, respectively.

The primary 36 and secondary 38 air heaters heat ambient air 60, supplied by draft fan 61, to produce primary air 62 and secondary air 64. The primary air 62 passes through the pulverizers 14 to dry and carry the coal 12 to the burners 16. The majority, 80 to 90%, of the ambient air 60 is supplied as secondary air 64 directly to the furnace 20 to support combustion of the coal. The primary air 62 typically is hotter than the secondary air 64 since the sensible heat of primary air is required to dry the coal and to increase its temperature in preparation for burning. Thermodynamically, optimum operation of air heaters is achieved when the temperature of the combustion product gases leaving the primary 36 and secondary 38 air heaters are equal. Some coals can be softened or ignited by the high temperature of the primary air 62. If the temperature of the primary air 62 is above a desired operating level, tempering air 68 is supplied by a tempering air fan 70.

Figure 2:
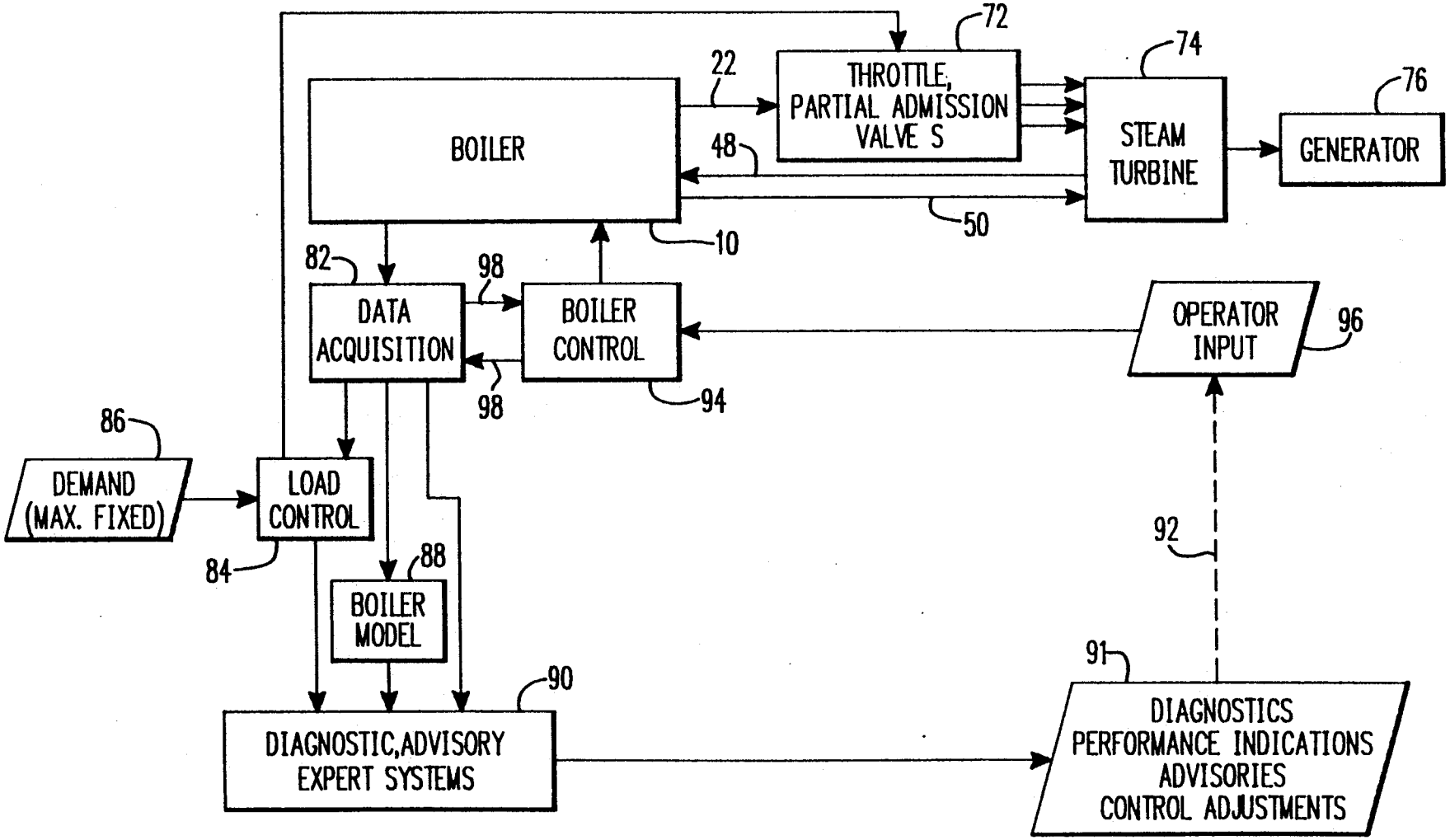
FIG. 2 is block diagram of a control system embodying the present invention.

As illustrated in FIG. 2, the superheated steam 22 passes through partial admission and throttle valves 72 to the high pressure section of a steam turbine 74 which drives an electrical generator 76. The cold reheat steam 48 is returned to the boiler 10 to produce the reheated steam 50. The superheat 52 and reheat 54 steam temperature detectors, as well as other sensing devices, such as feedwater 78, fuel/air 80 and secondary air 81 temperature detectors (FIG. 1) are accessed by a data acquisition system 82. The data acquired by the data acquisition system 82 is supplied to a load control system 84 which receives the requested operation level, as indicated by demand 86 to select which of the partial admission valves 72 should be fully opened.

According to the present invention, a boiler model 88 also receives data from the data acquisition system 82. The boiler model may be based upon, e.g., PEPSE code, to predict sensible heat loss and unburned fuel content to determine an optimum air/fuel mixture. In addition, the decision made by the load control system 84 and predictions made by the boiler model 88, together with the data acquired by the data acquisition system 82 is supplied to diagnostic and advisory expert systems 90. The expert systems 90 produce diagnostics, performance indications, advisories and recommended control adjustments 91 to a human operator, as indicated by dashed line 92. While the decisions of the expert system could be directly supplied to a boiler control system 94, in the preferred embodiment, a human operator confirms that the recommended actions should be taken and generates operator input 96 for the boiler control system 94. As indicated by arrows 98, the boiler control system 94 can automatically perform some control operations, such as introduction and control of sprays 56, 58 to maintain the superheat $T_{SH}$ and reheated $T_{RH}$ steam temperatures at the desired operating values.

Preferably the coal 12 passes through a bulk material analyzer (not shown) which provides an on-line analysis of the coal 12 supplied via the data acquisition system 82 to the boiler model 88 and expert systems 90. The coal analysis is used to determine the optimum air/fuel ratio and the desired temperature of the primary air 62 and to predict when soot blowing will be necessary and effective in enhancing the heat transfer in a section of the boiler 10. The recommended control adjustments included in the information supplied to the operator by the expert systems 90 include information in maintaining the pressure of the superheated steam 22 at a level which allows the throttle valves 72 to be kept fully open so that the pressure loss across the throttle valves is minimized.

In fine tuning the operation of the coal-fired boiler 10, the introduction of low temperature substances, such as the sprays 56, 58 and tempering air 68 is minimized by comparing the superheat $T_{SH}$ and reheat $T_{RH}$ steam temperatures and the fuel/air temperature $T_{RH}$ from temperature detectors 52, 54, 80 with desired operating values. If the superheat $T_{SH}$ and reheat $T_{RH}$ steam temperatures are high or the automatic spray control portion of the boiler control system 94 is introducing sprays 56, 58 prior to producing the superheated steam 22 or reheated steam 50, the combustion product gas temperature should be reduced prior to reaching the platen 24 and secondary 26 superheater sections. This is preferably accomplished by performing the following steps in sequence until the superheat $T_{SH}$ and reheat $T_{RH}$ steam temperatures are the desired operating values and if possible, there are no spray flows prior to producing the superheated 22 and reheated 50 steam. First, if the expert systems 90 determine that soot blowing is likely to be effective, soot blowing is performed in the furnace section 20 of the boiler 10. This increases the heat transfer between the exhaust gases in the furnace 20 and the walls 44. As a result, the exhaust gases reaching the platen 24 and secondary 26 superheaters are cooler and the amount of steam produced by the furnace 20 is greater. As a result, the temperature $T_{SH}$ of the superheated steam 22 is lower, but more steam is being produced. Since the superheated steam 22 will be cooler, the cold reheat steam 48 will also be cooler thus reducing the temperature $T_{RH}$ of the reheated steam 50.

Second, a burner tilt control 98 (FIG. 1) is adjusted to lower the combustion region 18 in the furnace 20 by either tilting or biasing the burner 16 downwards. Burners can be angled upwards and downwards as indicated by the double arrow 100. In addition, or as an alternative, the burners may be individually controllable so that the coal being supplied to the upper burners is reduced or cut off and lower burners receive an increased amount of coal flow so that the temperature in the combustion region 18 does not significantly decrease. Using either or both techniques, the combustion region 18 will be lowered in the furnace 20 so that a larger amount of surface area of the walls 44 will be available to absorb the heat of the exhaust gases, thereby reducing the temperature of the exhaust gases reaching the platen 24 and secondary 26 superheaters.

Third, if soot blowing of the furnace 20 and burner tilt are insufficiently effective, the flow rates of the primary 62 and secondary 64 air can be increased by adjusting the draft fan 61. This increases the volume of air in the furnace section 20 and since the same amount of heat is being produced, the temperature of the combustion product gases will be lowered. Since this requires an increased amount of electricity on an ongoing basis, it is less desirable than the previous two steps.

Fourth, the windbox pressure in the proximity of the burners 16 can be increased by adjusting vanes directing the secondary air flow. The resulting increased windbox pressure and flow turbulence will result in greater combustion intensity and a reduced flame length; the combustion region 18 will be effectively lower in the furnace. Also, the pulverizers 14 can be adjusted to decrease fuel particle size. The more finely ground coal 12 will burn in a more compact and hotter combustion region 18. This increases the heat transfer to the walls 44 of the furnace 20 near the combustion region 18, reducing the temperature of the exhaust gases which reach the platen 24 and secondary 26 superheaters. If all of these techniques are unsuccessful in reducing the temperature $T_{SH}$ of the superheated steam 22 and reheated steam 50, the only alternative is to increase the spray flows 56 and 58, as needed.

If the reheat steam temperature $T_{RH}$ is below a corresponding desired operating value and either the superheat steam temperature $T_{SH}$ or the superheater spray flow 56 is above the corresponding desired operating values, the heat is redistributed from the superheater section 24, 26, 28 to the reheater section 30. This is accomplished by first decreasing the spray 58 into the cold reheat steam 48, if there is any reheat spray flow 58. Second, the reheater section 30 undergoes soot blowing, if the expert systems 90 indicate that soot blowing is likely to be effective in improving the heat transfer in the reheater section 30. If the first two techniques are ineffective, or unavailable, i.e., there is no reheat spray 58 into the cold reheat steam 48, a front pass/back pass damper 102 is adjusted to increase the flow of exhaust gases through the reheater section 30 and decrease the flow of exhaust gases through the primary superheater 28 and upper economizer 32. If none of the above techniques are effective, the recycling of exhaust gas can be increased and as a last resort, the coal and air flows can be increased with appropriate adjustments in soot blowing, burner tilt, pulverizer/-burner operation and superheat spray flow to attain the desired operating steam flow and superheat and reheat steam temperatures.

When the expert systems 90 determine that the superheat steam temperature $T_{SH}$ is below a corresponding desired operating value, and the reheat steam temperature $T_{RH}$ is above its corresponding desired operating value or there is reheat spray 58 into the cold reheat steam 48, the following steps are performed in order until the boiler is operating at the desired operating values. First, any superheat spray 56 is decreased. If this is insufficient to reach the desired operating values, or there is no superheat spray 56, the superheater section, including the platen 24, secondary 26 and primary 28 superheaters, undergoes soot blowing if the expert systems 90 determine that soot blowing is likely to be effective. If these steps do not result in redistributing heat from the reheater section 30 to the superheater section 24, 26, 28, the front pass/back pass damper 102 is adjusted to decrease exhaust gas flow through the primary superheater 28 and increase the exhaust gas flow through the reheater 30. Finally, exhaust gas recycling can be decreased and as a last resort the reheat spray 58 can be increased to lower the temperature $T_{RH}$ of the reheated steam 50.

If both the superheat $T_{SH}$ and reheat $T_{RH}$ steam temperatures are lower than the desired operating values, the following steps are performed in order. First, any spray flows 56, 58 into the superheated steam 22 exiting the secondary superheater 26 and into the cold reheat steam 48 are decreased. Secondly, if the expert systems 90 determine that soot blowing is likely to be effective, both the superheater section, including the platen 24, secondary 26 and primary 28 superheaters, and the reheater section 30 undergo soot blowing. If these techniques are insufficient to raise the superheat steam temperature $T_{SH}$ and reheat steam temperature $T_{RH}$ to the desired operating values, the temperature of the combustion product exhaust gases exiting the furnace 20 are increased. First, the combustion region 18 in the furnace 20 is raised, if possible, by tilting or biasing the burners 16 upwards. Next, the total primary 62 and secondary 64 airflow is decreased if reduced oxygen levels are practical. Finally, windbox pressure can be decreased and fuel particle size increased by adjusting the pulverizers 14. The effect of increasing fuel particle size enlarges the size of the combustion region 18 and reduces the temperature within the combustion region 18. As a result, heat transfer to the walls 44 is less efficient and more of the heat remains in the exhaust gases exiting the furnace section 20.

Other data obtained by the data acquisition system 82 may include drum feed water temperature $T_{FW}$ from the feed water temperature sensor 78 and the temperature $T_{FA}$ of the fuel/air mixture from temperature sensor 80. If the feedwater temperature $T_{FW}$ is lower than the corresponding desired operating value, the expert systems 90 advise the operator to perform the following steps in order. First, the economizer, including the upper economizer 32 and lower economizer 34 should undergo soot blowing, if the expert systems 90 determine that soot blowing is likely to be effective. Second, the front pass/back pass damper 102 can be adjusted to increase flow of the exhaust gases through the primary superheater 28 and upper economizer 32 and decrease the exhaust gas flow through the reheater 30. If the temperature $T_{RH}$ of the reheated steam 50 is also low, the front pass/back pass damper 102 will likely be adjusted in the opposite direction, unless other techniques are available to increase the temperature $T_{RH}$ of the reheated steam 50. As a last resort, flue gas recycling can be increased.

If the temperature $T_{FA}$ of the fuel/air mixture is detected by temperature sensor 80 to be above the desired operating value, the primary/secondary damper 104 can be adjusted to increase the combustion product exhaust gas flow through the secondary air heater 38 and decrease the exhaust gas flow through the primary air heater 36. If there is no damper 104 available, or its adjustment range is limited so that the fuel/air temperature $T_{FA}$ remains too high, the tempering air 68 can be increased. As a last resort, the ratio of primary air to secondary air can be adjusted to decrease the volume of primary air.

If the fuel/air temperature $T_{FA}$ detected by sensor 80 is below the desired operating value, the first step is to decrease the flow of tempering air 68 down to zero. If the fuel/air temperature $T_{FA}$ remains low and the expert systems 90 determine that soot blowing could be effective, the primary air heater 36 should undergo soot blowing. If this is ineffective, the primary/secondary damper 104 should be adjusted to increase the exhaust gas flow through the primary air heater 36 and decrease the exhaust gas flow through the secondary air heater 38. As a last resort, the ratio of primary air 62 to secondary air 64 can be increased. Since the temperature of the primary air 62 is decreased in the process of drying the coal 12 in the pulverizers 14, increasing the volume of primary air tends to increase the fuel/air temperature $T_{FA}$, while decreasing the volume of primary air 62 tends to decrease the fuel/air temperature $T_{FA}$. When the secondary air temperature $T_{SA}$ is detected by detector 81 to be below the corresponding desired operating value, secondary air heater 30 should undergo soot blowing.

By recommending adjustments to the operation of the boiler 10 in the order described for each situation, the expert systems 90 are able to minimize the use of auxiliary power in addition to minimizing thermodynamic losses due to pressure over the throttle valves and to spray flows into the steam. The use of electrical power to operate fans and pumps (for the sprays) is minimized.

The expert systems 90 used in the present invention can be created using any known expert system shell, programmed by one or more experts on the operation of the particular boiler 10. One such expert system shell is Personal Consultant Plus, available from Texas Instruments, Inc. Other expert system shells are available commercially, or the expert system can be written in a general purpose programming language, such as LISP, PASCAL, C, or FORTRAN.

The many features and advantages of the present invention are apparent from the detailed specification, and thus it is intended by the appended claims to cover all such features and advantages of the method and apparatus which fall within the true spirit and scope of the invention. For example, other operations of a boiler, whether coal-fired or not, could be adjusted to provide greater efficiency, based on recommendations from an expert system using data from sensors. Further, since numerous modifications and changes will readily occur to those skill in the art, it is not desired to limit the invention to the exact construction and operation illustrated and described. Accordingly, all suitable modifications and equivalents may be resorted to, all falling within the scope and spirit of the invention.

What is claimed is:

1. A method for controlling operation of a boiler, comprising the steps of:

(a) setting valves controlling steam output from the boiler in dependence upon a requested operation level;

(b) adjusting air/fuel ratio for optimal operation;

(c) minimizing pressure loss across throttle valves; and (d) minimizing thermodynamic loss caused by introduction of low temperature substances into the boiler to safely maintain the requested operation level.

2. A method as recited in claim 1, wherein step (d) comprises the step of (d1) adjusting temperature distribution within the boiler to minimize the need for introducing low temperature substances.

3. A method as recited in claim 2, wherein step (d) further comprises the step of (d2) avoiding introduction of sprays into steam, and wherein step (d1) comprises the step of (d1a) adjusting temperature distribution within the boiler to decrease the temperature of the steam produced prior to the introduction of the sprays.

4. A method as recited in claim 3, wherein the boiler is fueled by solid fuel supplied by pulverizers to burners in a furnace in the boiler, and wherein step (d1A) comprises at least one of:

(d1Ai) blowing soot collected in the furnace;

(d1Aii) lowering a region of combustion of the solid fuel in the furnace by at least one of tilting and biasing the burners;

(d1Aiii) increasing primary and secondary air flow into the furnace;

(d1Aiv) increasing windbox pressure;

(d1Av) adjusting the pulverizers to decrease fuel particle size.

5. A method as recited in claim 3, wherein the boiler is fueled by solid fuel carried into a furnace of the boiler by primary air and combined with secondary air and the primary air during combustion in the furnace, and wherein step (d1) further comprises the step of (d1B) adjusting the temperature distribution to avoid introduction of tempering air into the primary air to reduce the temperature of the primary air.

6. A method as recited in claim 5, wherein step (d1B) comprises at least one of the steps of:

(d1Bi) adjusting exhaust gas flow to increase flow of the exhaust gases used to heat the secondary air and decrease flow of the exhaust gases to heat the primary air;

(d1Bii) blowing soot in at least one section of the boiler upstream from a heat exchanger for heating the primary air; and (d1Biii) decreasing recycling of the exhaust

7. A method as recited in claim 1, further comprising the step of (e) minimizing use of auxiliary power.

8. A method as recited in claim 7, wherein step (e) includes minimizing the use of electric fans and pumps.

9. A method for fine tuning operation of a coal-fired boiler having a furnace section, a superheater section and a reheater section, comprising the steps of:

(a) detecting superheat steam temperature, superheater spray flow, reheat steam temperature and reheater spray flow;

(b) comparing the superheat and reheat steam temperatures and superheater and reheater spray flows with desired operating values;

(c) reducing combustion product exhaust gas temperature in at least one of the superheater and reheater sections, if at least one of the superheat and reheat steam temperatures and superheater and reheater spray flows are above the desired operating values, with none below the desired operating values;

(d) redistributing heat from the superheater section to the reheater section, if the reheat steam temperature is below a corresponding desired operating value and at least one of the superheat steam temperature and superheater spray flow is above corresponding desired operating values;

(e) redistributing heat from the reheater section to the superheater section, if the superheat steam temperature is below a corresponding desired operating value and at least one of the reheat steam temperature and reheater spray flow are above corresponding desired operating values; and (f) increasing heat transfer in the superheater and reheater sections if both the superheat and reheat steam temperatures are lower than the desired operating values.

10. A method as recited in claim 9, wherein the furnace section includes burners producing a combustion region and the boiler further includes primary and secondary air heaters and is controlled to operate with fully open throttle valves and an efficient air/fuel ratio, and wherein step (c) comprises performing the following steps in sequence until the superheat and reheat steam temperatures and superheater and reheater spray flows are within the desired operating values:

(c1) blowing soot in the furnace section to increase production of steam;

(c2) lowering the combustion region in the furnace by at least one of tilting and biasing the burners downwards;

(c3) decreasing recycling of flue gases as combustion gases;

(c4) increasing secondary airflow;

(c5) increasing windbox pressure;

(c6) adjusting the pulverizers to size; and (c7) increasing at least one of superheater and reheater spray flow.

11. A method as recited in claim 9, wherein the boiler further includes a front pass/back pass damper for adjusting exhaust gas flow through the reheater section and at least a portion of the superheater section, and wherein said redistributing in step (d) comprises performing the following steps in sequence until the superheat and reheat steam temperatures and superheater and reheater spray flows are within the desired operating values:

(d1) decreasing the reheat spray flow;

(d2) blowing soot in the reheater section to improve heat transfer;

(d3) redistributing the exhaust gas flow from at least a portion of the superheater section to the reheater section by adjusting the front pass/back pass damper;

(d4) increasing recycling of the exhaust gases; and (d5) increasing the superheater spray flow.

12. A method as recited in claim 9, wherein the boiler further includes a front pass/back pass damper for adjusting exhaust gas flow through the reheater section and at least a portion of the superheater section, and wherein said redistributing in step (e) comprises performing the following steps in sequence until the superheat and reheat steam temperatures and the superheater and reheater spray flows are within the desired operating values:

(e1) decreasing the superheater spray flow;

(e2) blowing soot in the superheater section to improve heat transfer therein;

(e3) redistributing the exhaust gas flow from the reheater section to at least part of the superheater section by adjusting the front pass/back pass damper;

(e4) decreasing recycling of the exhaust gases; and (e5) increasing the reheater spray flow.

13. A method as recited in claim 9, wherein the furnace section includes burners producing a combustion region and receives primary air flow carrying said fuel with a fuel particle size from a pulverizer and secondary air flow supporting combustion, and wherein said increasing in step (f) comprises performing the following steps in sequence until the superheat and reheat steam temperatures and superheater and reheater spray flows are within the desired operating values;

(f1) decreasing the superheater and reheater spray flows;

(f2) blowing soot in the superheater and reheater sections;

(f3) raising the combustion region in the furnace section by at least one of tilting and biasing the burners upwards;

(f4) decreasing the secondary air flow;

(f5) decreasing windbox pressure; and (f6) adjusting the pulverizers to increase the fuel particle size.

14. A method as recited in claim 9, wherein the furnace section further includes a steam drum and the boiler further includes an economizer section and a condenser supplies feedwater to the economizer section of the boiler, and wherein said method further comprises the steps of:

(g) detecting the temperature of the feedwater to the steam drum; and (h) performing, if the temperature of the feedwater is lower than a corresponding desired operating value, the following steps in sequence until the temperature of the feedwater is within the desired operating values:

(h1) blowing soot in the economizer section to improve heat transfer therein;

(h2) redistributing heat between the economizer section and the reheater section in dependence upon the reheat steam temperature; and (h3) increasing exhaust gas recycling.

15. A method as recited in claim 14, wherein the economizer section includes an upper economizer and a lower economizer and the boiler further includes a front pass/back pass damper controlling exhaust gas flow through the reheater section and the upper economizer, and wherein step (h2) comprises the steps of:

(h2A) adjusting the front pass/back pass damper to increase the exhaust gas flow through the upper economizer and decrease exhaust gas flow through the reheater section, if the reheat steam temperature is higher than a first corresponding desired operating value; and (h2B) adjusting the front pass/back pass damper to increase the exhaust gas flow through the reheater section and decrease the exhaust gas flow through the upper economizer, if the reheat steam temperature is below a second corresponding desired operating value.

16. A method as recited in claim 9, wherein the boiler further includes primary and secondary air heaters for supplying primary and secondary air, the primary air carrying coal from pulverizers to burners in the furnace section, and a primary/secondary damper for controlling combustion product exhaust gas flow through the primary and secondary air heaters, a supply of tempering air being provided as necessary to reduce the temperature of the primary air, and wherein said method further comprises the steps of:

(g) detecting fuel/air temperature of the primary air carrying the coal to the burners and tempering air flow of the tempering air supplied to the primary air; and (h) reducing the temperature of the primary air output from the primary air heater if at least one of the fuel/air temperature and the tempering air flow is above first corresponding desired operating values and increasing the temperature of the primary air output from the primary air heater if the fuel/air temperature is below a second corresponding desired operating value.

17. A method as recited in claim 16, wherein step (h) comprises performing, when at least one of the fuel/air temperature and the tempering air flow are above the first corresponding desired operating values, in sequence until step (h) no longer needs to be performed;

(h1) adjusting the primary/secondary damper to reduce the combustion product exhaust gas flow through the primary air heater;

(h2) increasing the tempering air flow;

(h3) adjusting the primary/secondary damper to increase exhaust gas flow through the primary air heater and decrease the exhaust gas flow through the secondary air heater; and (h4) decreasing flow of the primary air and increasing flow of the secondary air.

18. A method as recited in claim 16, wherein step (h) comprises the step of performing, when the fuel/air temperature is below a corresponding desired operating value, the following steps in sequence until step (h) no longer needs to be performed:

(h1) decreasing flow of the tempering air;

(h2) blowing soot in the primary air heater;

(h3) adjusting the primary/secondary damper to increase exhaust gas flow through the primary air heater and decrease the exhaust gas flow through the secondary air heater; and (h4) increasing flow of the primary air and decreasing flow of the secondary air.

19. A method as recited in claim 9, wherein the boiler further comprises primary and secondary air heaters for supplying primary and secondary air, the primary air carrying fuel to burners in the furnace section of the boiler and the secondary air being supplied directly to the burners in the furnace section, and wherein said method further comprises the steps of:

(g) detecting the temperature of the secondary air; and (h) blowing soot in the secondary air heater, if the temperature of the secondary air is below a corresponding desired operating value.

20. An apparatus for controlling operation of a boiler, comprising:

load control means for setting valves controlling steam output from the boiler in dependence upon a requested operation level and minimizing pressure loss across throttle valves; and boiler controller means for adjusting air/fuel ratio for optimal operation and minimizing thermodynamic loss caused by introduction of low temperature substances into the boiler to safely maintain the requested operation level.

21. An apparatus as recited in claim 20, wherein the boiler includes a furnace section having a combustion region, a superheater section, a reheater section and primary and secondary air heater sections, wherein said apparatus further comprises:

data acquisition means for detecting superheat steam temperature, superheater spray f.low, reheat steam temperature and reheater spray flow; and evaluation means for comparing the superheat and reheat steam temperatures and superheater and reheater spray flows with the requested operation level, and wherein said boiler control means comprises:

burner control means for adjusting the combustion region in the furnace section to reduce exhaust gas temperature of exhaust gases exiting therefrom, when at least one of the superheat and reheat steam temperatures and superheater and reheater spray flows are above the requested operation level and none are below the requested operation level and for increasing the temperature of the exhaust gases exiting from the furnace section if both the superheat and reheat steam temperature are below the requested operation level; and redistribution means for redistributing heat from one of the superheater and reheater sections to the other of the superheater and reheater sections when at least one of the superheat and reheat steam temperatures and superheater and reheater spray flows, corresponding to one of the superheater and reheater sections, is above the requested operation level and another of the superheat and reheat steam temperatures and superheater and reheater spray flows, corresponding to the other of the superheater and reheater sections, is below the requested operation level.

22. An apparatus as recited in claim 21, wherein the superheater section includes a primary superheater and a secondary superheater and the boiler further includes a front pass/back pass damper for controlling exhaust gas flow through the reheater section and the primary superheater and soot blowers in each of the primary and secondary superheaters and the reheater section, and wherein said redistribution means comprises:

spray flow control means for decreasing one of the superheater and reheater spray flows in dependence upon the detecting performed by said detection means;

soot blower controller means for controlling soot blowing in the primary and secondary superheaters and the reheater section in dependence upon the detecting performed by said detection means;

damper control means for controlling the front pass/back pass damper in dependence upon the detecting performed by said detection means; and flow control means for controlling adjustment of recycling combustion product exhaust gas.

* * * * *